United States Patent [19]

Bisczat et al.

[11] 4,273,456

[45] Jun. 16, 1981

[54] PAPER INSERTION APPARATUS FOR A TYPEWRITER

[75] Inventors: John J. Bisczat; Robert R. Lisk; William R. McCray, all of Lexington; James L. Sizemore, Cynthiana, all of Ky.

[73] Assignee: International Business Machines Corporation, Armonk, N.Y.

[21] Appl. No.: 945,922

[22] Filed: Sep. 26, 1978

[51] Int. Cl.[3] ..... B41J 19/76

[52] U.S. Cl. ..... 400/550; 400/549; 400/568; 400/572; 400/575; 400/582; 400/598; 400/639.1

[58] Field of Search ..... 400/549, 550, 568, 570, 400/572, 573, 575, 578, 582, 598, 636, 636.1, 639.1, 639.2; 364/200

[56] References Cited

U.S. PATENT DOCUMENTS

| | | | |
|---|---|---|---|
| 1,913,831 | 6/1933 | Clark | 400/549 X |
| 2,200,693 | 5/1940 | Geiser | 400/598 |
| 2,204,243 | 6/1940 | Anderson | 400/639.1 X |
| 2,210,168 | 8/1940 | Hart | 400/639.2 X |
| 2,353,407 | 7/1944 | Kurowski | 400/636 X |
| 2,463,259 | 3/1949 | Giauque | 400/550 |
| 2,472,340 | 6/1949 | Prezioso | 400/598 |
| 2,711,811 | 6/1955 | Lambert | 400/578 X |
| 2,944,651 | 7/1960 | Malcolm et al. | 400/550 X |
| 3,276,562 | 10/1966 | Mathews | 400/549 |
| 3,292,762 | 12/1966 | Erickson | 400/550 |
| 3,960,258 | 6/1976 | Aebi | 400/550 |
| 4,031,995 | 6/1977 | Blum et al. | 400/636.1 |
| 4,057,846 | 11/1977 | Cockerill et al. | 364/200 |
| 4,085,837 | 4/1978 | Takano et al. | 400/568 X |
| 4,087,852 | 5/1978 | Campbell et al. | 364/200 |

OTHER PUBLICATIONS

IBM Technical Disclosure Bulletin, "2-3-6 Lines/inch Flaten Indexing Method", Becker, vol. 17, No. 8, Jan. 1975, pp. 2355-2356.

IBM Technical Disclosure Bulletin, "Paper-Bail Actuation During Unattended Printout", Nilsson et al., vol. 19, No. 6, Nov. 1976, p. 1957.

IBM Technical Disclosure Bulletin, "Index Auto Paper Feed," Abell et al., vol. 20, No. 10, Mar. 1978, pp. 4000-4001.

*Primary Examiner*—Ernest T. Wright, Jr.

*Attorney, Agent, or Firm*—George E. Grosser

[57] ABSTRACT

Paper insertion apparatus for indexing a typewriter to a desired first line printing position is triggered using a position detector cooperating with an operator movable paper hold-down bail. When the paper bail is moved to a withdrawn position relative to the paper feed path, the detector produces a signal that causes a logic processor to access, from a dedicated storage location, a code indicating paper advancing increments corresponding to a desired first line printing position. The processor then commands an indexing drive to advance that number of increments. In a preferred implementation, the operator can condition the typewriter to receive a new first line code into storage by means of the keyboard.

By so using the presence of the paper bail in a withdrawn position to input the operator's paper insertion request, problems of automatically clearing the path for the leading paper edge are averted and the natural association of the paper bail with paper handling is exploited. And, by using the keyboard to indicate a desired first line position, special input devices such as dials or positionable selection levers are not required.

8 Claims, 12 Drawing Figures

INPUT OF FIRST LINE CODE USING NUMBER KEYS

PAPER INSERTION APPARATUS FOR A TYPEWRITER

BACKGROUND OF THE INVENTION

1. Field of the Invention

The invention relates generally to paper handling for a typewriter and, more particularly, to apparatus for advancing a sheet of paper to a desired first line printing position.

2. Statement Regarding the Prior Art

Various apparatus has been proposed and implemented for semi-automatically inserting paper into a typewriter. Generally, however, such apparatus has had limited appeal because complicated special purpose mechanisms were required that unduly increased machine costs and because the operator was required to learn a somewhat involved procedure to achieve a result that could be accomplished manually with only a moderate effort.

The increase in costs and complexity arises because provision must be made for operator indication of the desired first line printing position and because the paper path must be prepared for paper insertion, for example, by moving a paper hold-down device at the printing line out of the paper path so as not to interfere with the leading edge of the incoming page (or pack including carbons).

Various selector devices have been used to allow the operator to indicate a desired first line printing position. Typically a dial (see e.g., U.S. Pat. Nos. 3,960,258 and 3,276,562) or a selection lever (see e.g., U.S. Pat. No. 2,463,259) is employed for indicating the desired first printing line and these devices are coupled to mechanical stops or clutch disengaging devices to limit total paper advance.

The problem of getting the leading edge of the paper past the printing zone has proven to be troublesome one. To achieve the basic typing function, i.e., the crisp printing of characters, the paper must be held snugly to the platen in the printing zone. But the paper hold-down device, typically a series of rollers on a bail, does not, when in operative position, allow easy passage of the paper past the printing zone. In fact, jamming typically occurs if the device is not manually withdrawn, and such jamming may cause unacceptable creasing of the paper.

One solution of this problem is to use a shaped guide plate (see e.g., U.S. Pat. No. 2,353,407) rather than rollers to hold the paper in position, but such arrangement would appear to have problems holding the paper effectively at the print line, especially if clearance provision must be made to thick carbon packs. A more common solution has been to provide an automatic drive arrangement for the paper hold-down bail (see e.g., U.S. Pat. Nos. 2,204,243; 2,210,168; 3,292,762; 3,960,258; and 4,031,195).

There is, of course a significant cost penalty for such limited purpose automatic drive mechanisms and there is possibly a maintenance problem if, for example, rearward hand or arm pressure is accidentally applied against the bail when it is being driven forward.

Hence, with prior art devices the convenience of semi-automatic paper insertion has involved significant cost penalties and special set up procedures that are rather distinct from manual paper insertion and, therefore, are not convenient for the operator to learn.

SUMMARY OF THE INVENTION

The invention involves a recognition that by detecting the presence of the paper hold-down device of a typewriter (e.g., a bail and associated rollers for urging the paper against a platen adjacent the typewriter's printing zone) at a position withdrawn from the paper feed path for the purpose of triggering a controller 1) to access a stored distance representative code and 2) to command a corresponding paper advance, paper insertion problems regarding provision for an unencumbered paper feed path are overcome without complex automated roller displacing devices or resort to special hold-down arrangements having diminished effectiveness. To enhance tactile feedback to the typewriter operator, an extreme withdrawn position is preferably detected, to which the paper hold-down device is operator moveable only against a resilient bias (e.g., an opposing spring tension).

By, furthermore, conditioning the typewriter control logic to respond to keyboard signals normally associated with printer commands as indicating desired first line distances, the keyboard is enabled to function additionally as an operator interface for page insertion information input. The keyboard signal is converted to a corresponding distance representative code which is stored in a dedicated storage location, and, hence, special purpose dials or selection levers are not needed to establish the desired first line distance. More specifically, a key such as the "CODE" key is, preferably used in conditioning the typewriter control logic to count indexing pulses (e.g., pulses generated in response to depressions of an "INDEX" key) and such count is then used to establish the first line distance code for storage at a storage location dedicated to receiving such information.

According to the preferred implementation for the invention, it will be appreciated that the operator control interfaces for paper insertion, i.e., the paper hold-down device and the "INDEX" key, have a natural association with paper handling, thus facilitating operator skill development in learning the semi-automatic paper insertion procedure.

The invention will now be described with respect to preferred implementations thereof and with reference to the drawings wherein:

FIG. 3 is a sectional representation, viewed along the line 3—3 of

Figure 1:
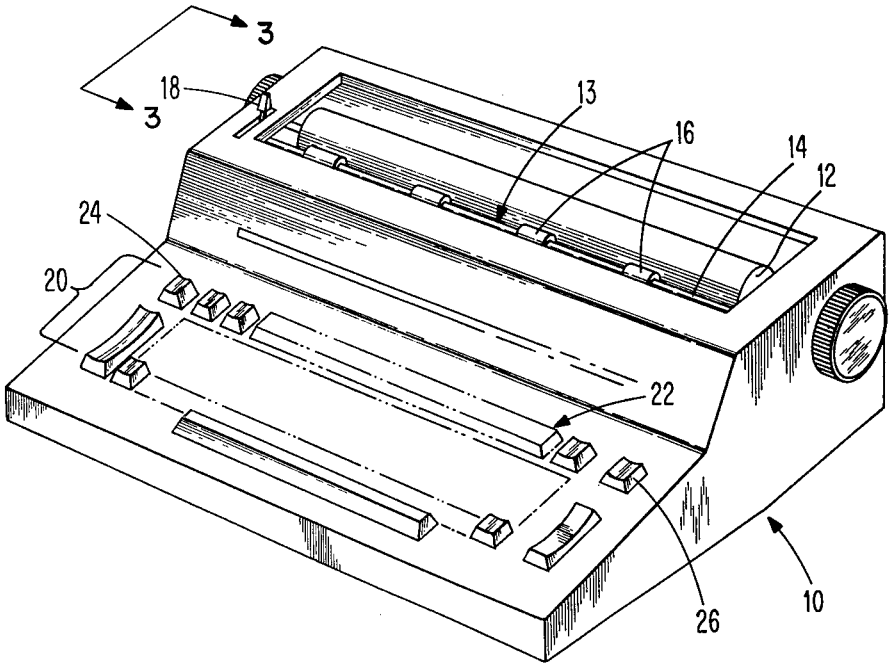
FIG. 1 is a perspective view of a typewriter suitable for use according to the invention.
Figure 4A:
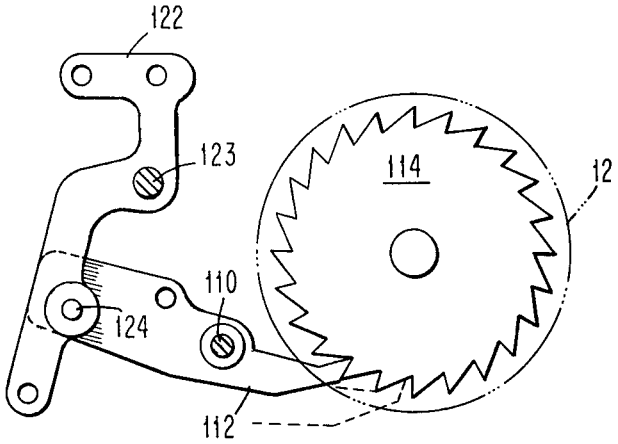
Figure 10:
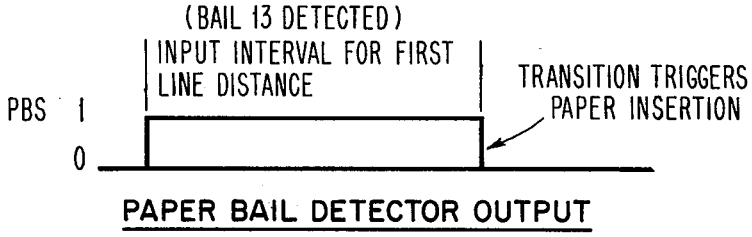
Figure 3:
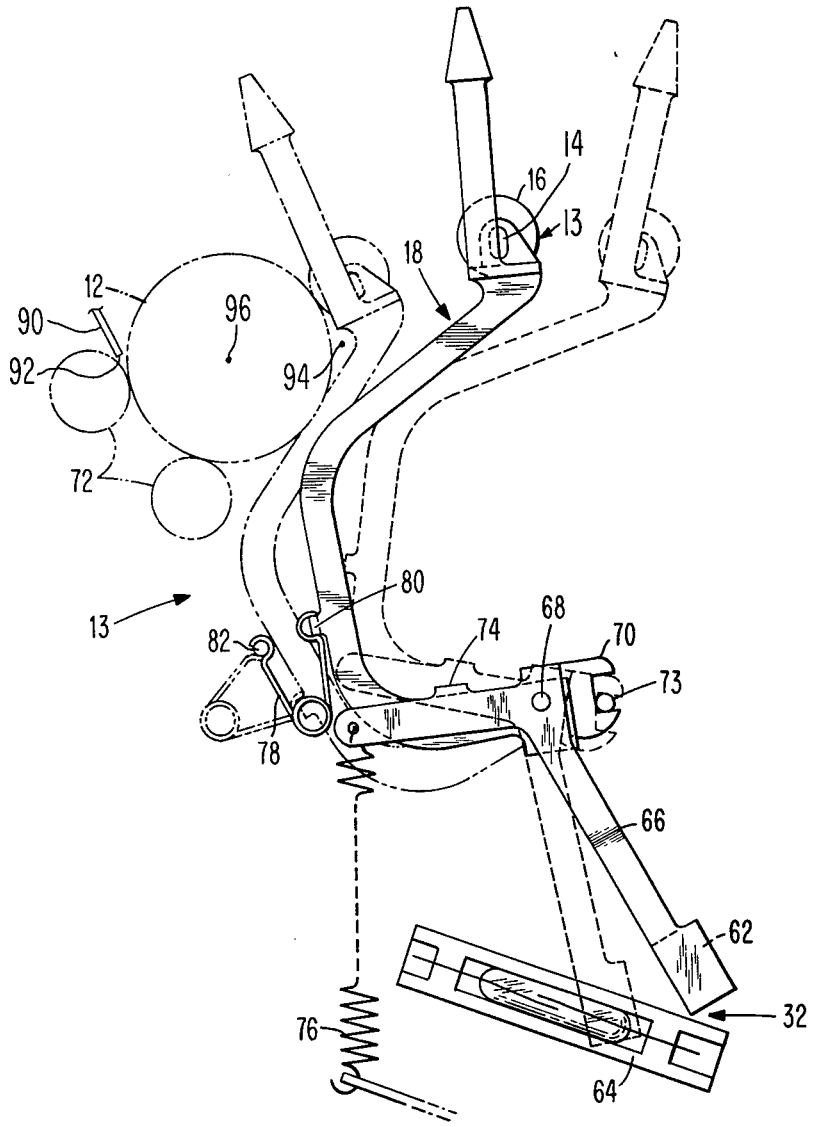
Figure 4:
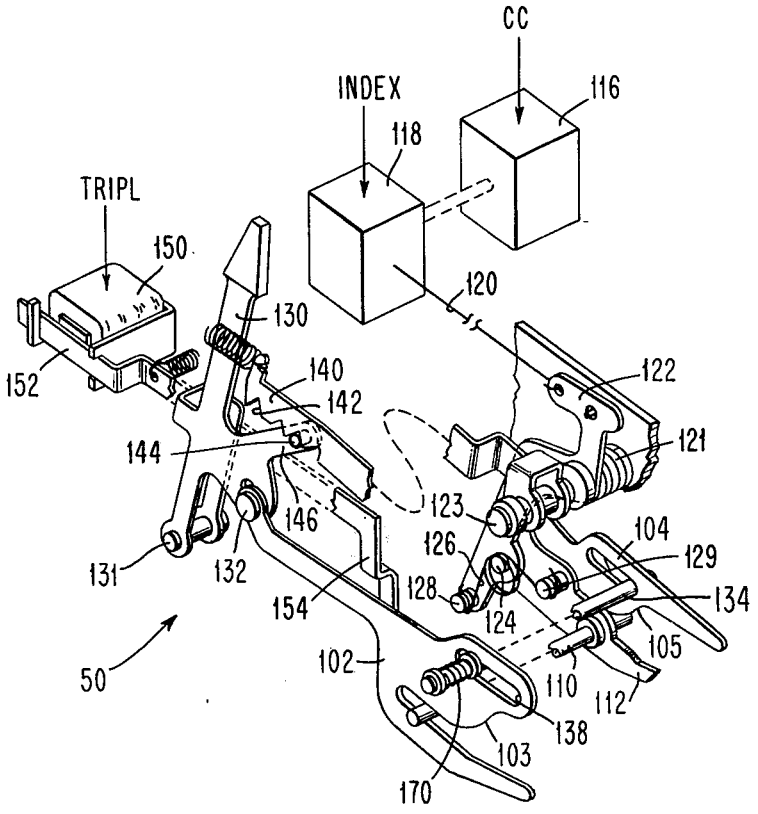
Figure 5:
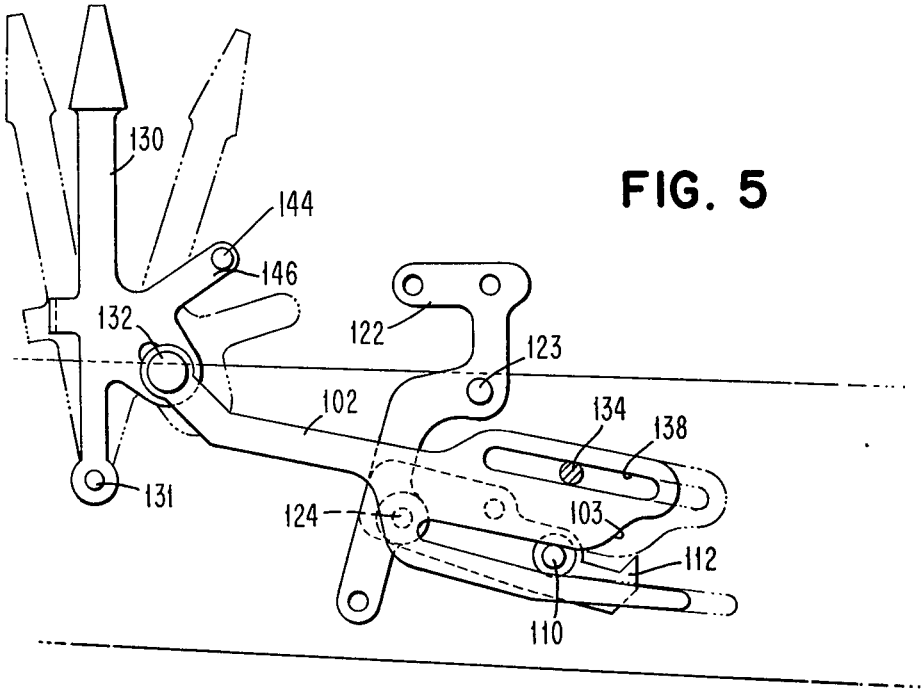
Figure 6:
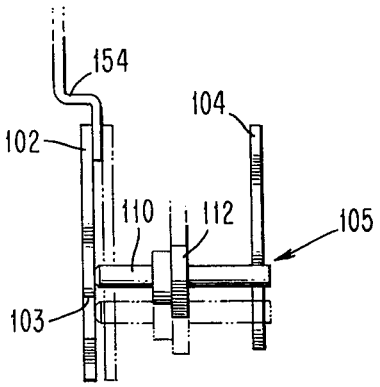
Figure 7:
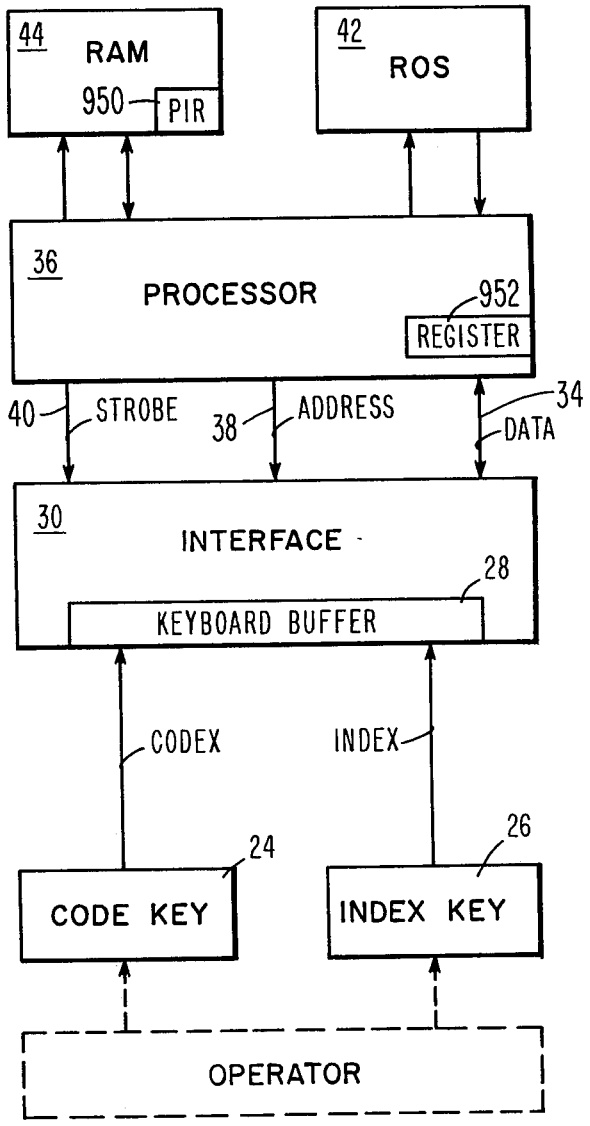
Figure 8:
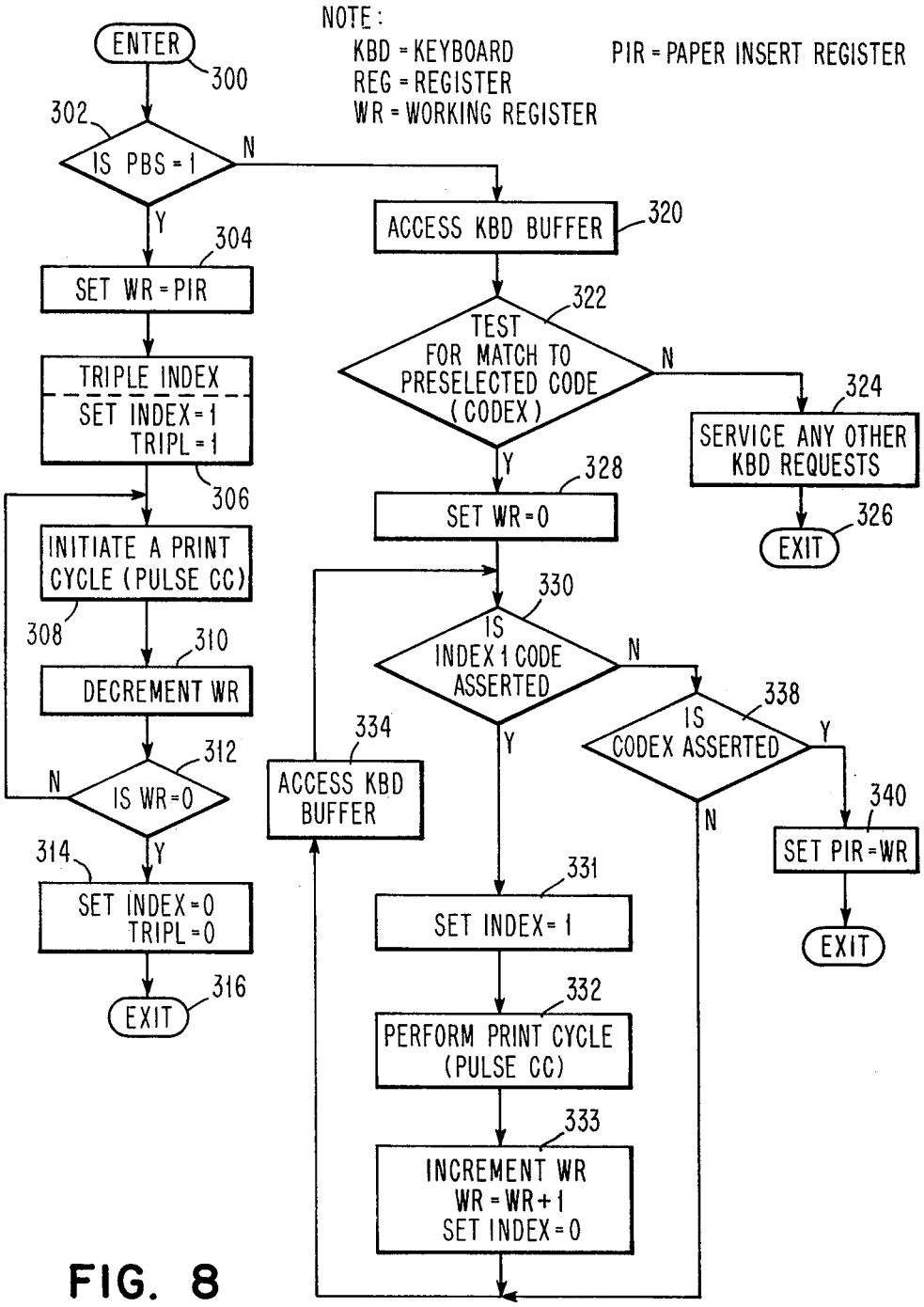
Figure 9:
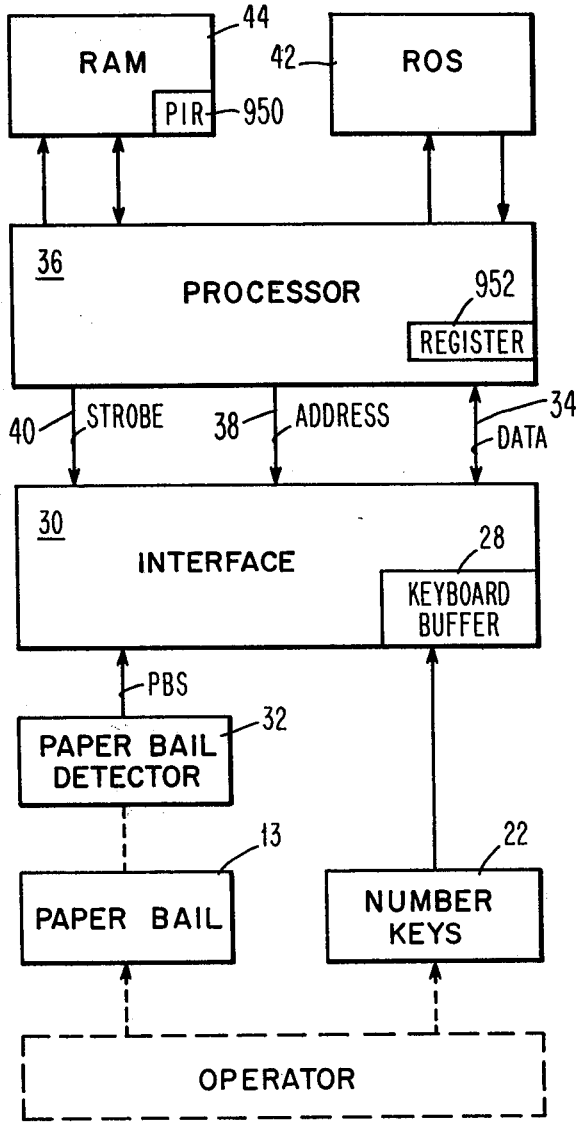
Figure 11:
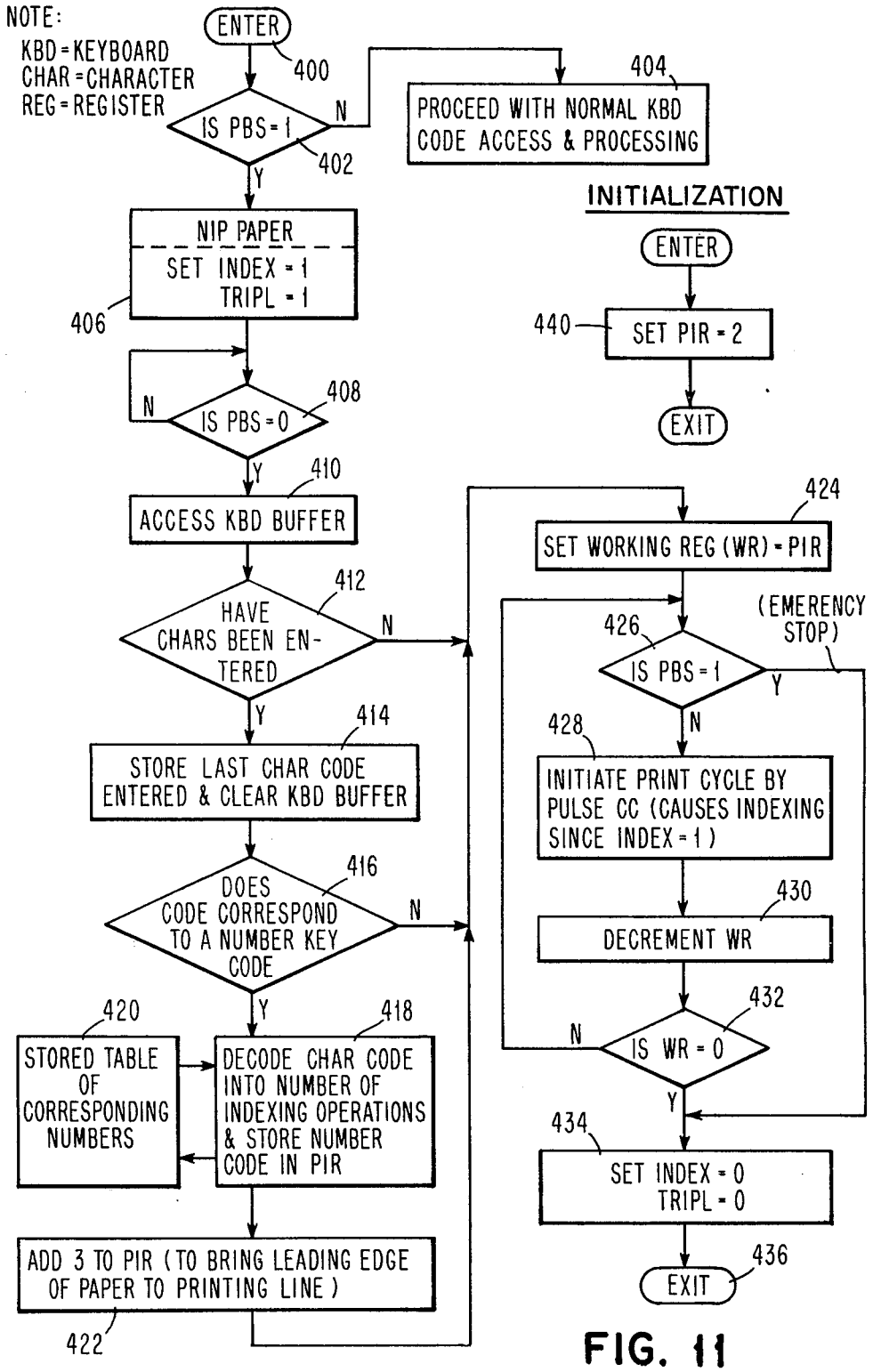

FIG. 1, for a presently preferred paper hold-down device with associated detector according to the invention;

FIG. 4 is a cutaway representation in perspective of a presently preferred indexing mechanism that permits special paper advance for paper insertion at a triple line rate without the loss of the operator selected line advance setting for normal operation;

FIG. 4*a* is a side view showing detail of the pawl and ratchet for the mechanism of FIG. 4;

FIG. 5 is a side view showing detail of the line advance selection for the mechanism of FIG. 3;

FIG. 6 is an end view showing detail of cam surface transfers for the mechanism of FIG. 3;

FIG. 7 is a diagram of block form indicating an input arrangement for first line distance code;

FIG. 8 is a flow diagram indicating the sequential logic for the implementation of FIG. 7;

FIG. 9 is a diagram in block form indicating a presently preferred, first line distance input arrangement;

FIG. 10 is a diagram indicating significant signal intervals for the presently preferred implementation of the invention; and FIG. 11 is a flow diagram indicating the sequential processing for the presently preferred implementation of the invention.

Referring to FIG. 1, a typewriter 10 suitable for use according to the invention includes a platen 12 and a paper hold-down device 13 such as a paper bail, 14 which supports a set of rollers 16 and is coupled to a control lever 18. Signal representing character printing and functional commands are generated by a keyboard 20 having various keys including a set of number keys 22, a code key 24 and an index key 26.

Figure 2:
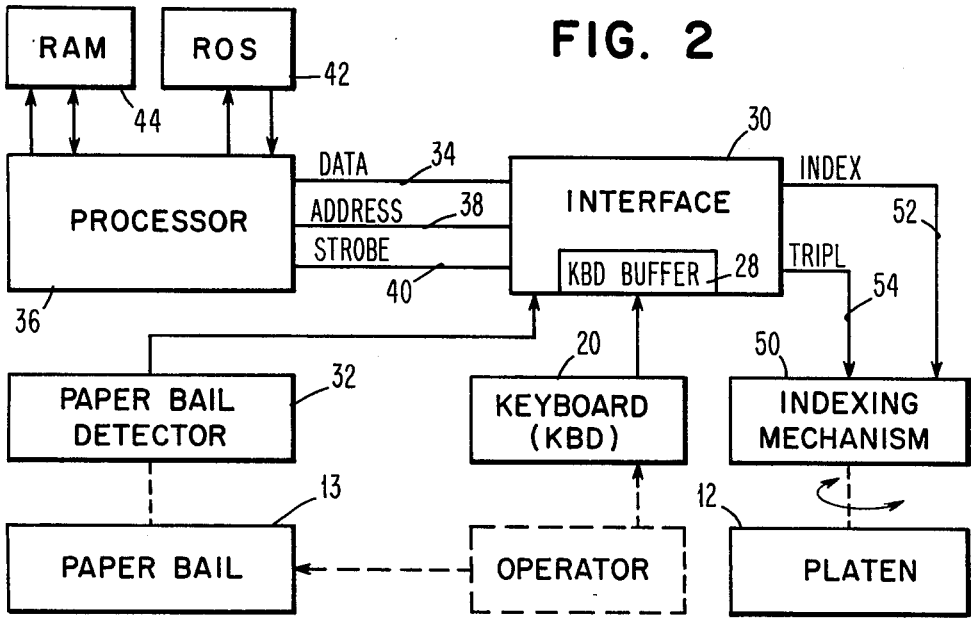
FIG. 2 is a system diagram in block form indicating basic signal flows for preferred implementations for the invention.

Activation of the typewriter 10 (indicated in FIG. 2) is generally initiated by the typewriter operator who, as is indicated by dashed lines, interacts with keyboard 20 to produce coded signals which are supplied to a keyboard buffer 28 of an interface device 30. Manipulation of the paper bail lever 18, as is described in detail below, causes a detector 32 to produce signals that are supplied to the interface 30. At the interface 30, signal information is buffered for transmission over a set of data lines 34 to a processor 36, such transmission being in response to respective addresses asserted on an address bus 38 in conjunction with a timing or strobe signal 40 as is well known in the art. While decoding and buffering is centralized in the interface 30 as shown (such as interface can, for example be employed with a processor having the bus structure described in U.S. Pat. No. 4,057,846) it will be appreciated that individual interface devices could be employed at the input and output devices, such as the keyboard 20, as is described in U.S. Pat. No 4,087,852. The processor 36 is adapted to perform various basic logic functions and a read-only storage (ROS) 42, incorporates the sequence of basic processor operations to be performed in the form of physical structures, as is known in the art. In performing such sequences or procedures, accessable code storage is occasionally required as provided by a read/write memory (RAM) 44.

Signals are sent from the processor 36 over the data lines 34 to the interface device 30 for controlling various output devices (again selected by corresponding addresses asserted on address bus 38), for example, the character selection apparatus (not shown) and an indexing device 50 which is mechanically coupled to drive the platen 12. In particular, addresses are assigned to an INDEX command signal 52 and a TRIPL command signal 54, which signals are supplied to the indexing device 50 via the interface 30 (which decodes the addresses to select the corresponding output channel) to cause an indexing operation and a shift to triple space increments respectively as is discussed in more detail below.

Referring to FIG. 3, a presently preferred paper hold-down device 13 for use according to the invention cooperates with a detector 32 having a magnet 62 and a reed switch 64 that is rigidly mounted to the typewriter frame (not shown). The magnet 62 is attached to an arm 66 that is pivoted at a pin 68 and includes a motion-limiting notched tab 70 that cooperates with a pin 73. Motion is transmitted to the arm 66 by engagement of the paper bail lever 18 with a tab 74. The lever 18 pivots about the pin 68 over a range of positions that include a paper hold-down position (phantom lines) a stable withdrawn position (solid lines) and an unstable extreme withdrawn position (dashed lines). In such withdrawn or "detection" position the arm 66 is driven against a spring 76 to cause the magnet 62 to influence reed switch 64 to a closed position and the spring action causes the position to be unstable. For the stable withdrawn position, lever 18 is held in place by a toggle spring 78 that is connected between a tab 80 and a fixed pin 82. In the paper hold-down position, lever 18 is urged by the spring 78 for biasing paper bail rollers 16 against the platen 12, which in cooperation with sets of feed rollers 72 defines a paper feed path.

A receiving medium 90, typically a sheet of paper, is indicated at a paper entrance 92 defined at the nip of the rollers 72 and platen 12. As is conventional, a printing line 94 of the typewriter 10 is established parallel to the longitudinal axis 96 of the platen 12. Character formation occurs along the printing line 94 during printing operation of typewriter 10 and various well known printing mechanisms (not shown) may be employed to form characters, e.g. a ball element printer or a ballistic wire printer.

Referring to FIGS. 4 and 4*a*, a presently preferred indexing mechanism 50 includes a first cam element 102 with a profile surface 103 for use in normal indexing operation and a second cam element 104 with a profile surface 105 that provides high speed indexing for paper insertion. A pin 110 serves as the cam follower and is affixed to a pawl 112 for controlling the point at which the pawl 112 engages a ratchet wheel 114 that is connected to the platen 12 (the longer the engagement the greater the advance increment). A drive motion for the pawl 112 is transmitted from a drive shaft (not shown) through a cycle clutch 116 to an indexing clutch 118 and then through a linkage 120 to a pivoted pawl carrier 122 that is rotatable about a pin 123 and is biased to pull against the linkage 120 by a spring 121. Cycles of operation are initiated by the signal CC which is supplied to cycle clutch 116 as is well known in the art. Pawl carrier 122 is connected to the pawl 112 by a pin 124 and a spring 126, tensioned between studs 128 and 129, serves to urge the pawl 112 toward the profile surfaces 103 and 105 respectively of the cam elements 102 and 104. The drive motion causes pawl 112 to reciprocate (a forward pawl position is indicated in dashed lines in FIG. 4*a*) and the extent of the cam profile 103 engaged by the pin 110 is manually adjustable by the operator by means of a selection lever 130 pivoted about a pin 131. Coupling of the cam element 102 to selection lever 130 is accomplished by means of a pin 132 and motion of the cam element 102 is constrained by fixed pin 134 which passes through a slot 138 (see also FIG. 5, where dashed lines indicate alternate cam position selections for cam element 102).

Discrete indexing positions are established by a detent bar 140 (see also FIG. 4) which is spring biased about the pivot pin 123 to engage, at a detented edge 142, a pin 144 which is arranged on an arm 146 of selection lever 130. For the normal or operative position of cam element 102, profile surface 103 is forward of or in line with profile surface 105 and hence controls the engagement point of pawl 112. Transfer of follower 110 from cam element 102 to cam element 104 is effected by means of an electromagnet 150 having armature 152 with an extended arm 154, that, when moved to an actuated position, engages and deflects the cam element 102 laterally (see FIG. 6). Activation of electromagnet 150 is effected by a signal denoted TRIPL and in the absence of an activating signal level to cause deflection of arm 154, a spring 170 provides force to urge cam element 102 to the normal position for camming engagement with follower pin 110. Whenever the signal TRIPL activates electromagnet 150 the follower pin 110 is urged against the generally less prominent profile surface 105 (see FIG. 6), which permits the pawl 112 to engage the ratchet wheel 114 over a relatively long portion of the pawl stroke and provides a three lie indexing increment. The engagement point for such three line increment operation is, of course, essentially the same as would occur with cam profile 103, if the operator selects a three line increment using the lever 130.

Referring to FIG. 7, signal flow for input of a first line distance code is initiated, for one embodiment of the invention, by operator depression of the code key 24 (or the code key in conjunction with another key say the "X" key) which produces a signal that triggers a sequence of processor logic for counting pulses produced as a result of the operator depression of the index key 26 until the next subsequent depression of the code key 24, at which time the count total is stored at a location (denoted PIR) 950 in the RAM 44.

The sequence of basic logic operations performed by processor 36 to effect such storage is defined by the physical structure of the ROS 42 and is best described to those skilled in the art in terms of a flow chart which may be straightforwardly converted into a ROS structure to cooperate with a chosen type of processor 36. Referring to FIG. 8 the logic (for the embodiment of FIG. 7) starts (block 300) at an entry point from an overall servicing loop (not indicated) for input signals e.g., the loop logic checks for and accessses all of the possible input signals from the keyboard 20 and any detectors (e.g. detector 32) or other signal source in a predefined sequence or with a predefined priority on an interrupt basis. A test (block 302) is made to determine the state of the signal PBS from the detector 32 (see FIG. 3). If the test indicates a detection, the contents of the paper index register (PIR) 950 in the RAM 44 are duplicated (block 304) in a working register 952 of the processor 36 (see also FIG. 7). To prepare for triple indexing (see also FIG. 4), the binary output signals to the indexing device 50, INDEX and TRIPL, are set to the "one" state (block 306). Triple indexing according to the value stored in the register 952 is triggered in a register decrementing logic loop (blocks 308–312) and when indexing to the desired first line position is completed the binary output signals INDEX and TRIPL are set to zero (block 314) and the sequence is exited (block 316) to the overall input signal servicing loop mentioned above.

If the test at block 302 fails the paper bail detector 32 is not activated and the logic sequence proceeds to access the keyboard buffer 28 (block 320). A test is performed (block 322) to determine whether or not a triggering code denoted CODEX—(e.g., a code produced by depression of the "CODE" key 24 or by depressing the code key 24 in conjunction with another key such as the "X" key which is not specifically shown) has been asserted. If not, other keyboard requests from buffer 28 are serviced (block 324) and the sequence returns to the overall input servicing loop (block 326).

If CODEX is found to be asserted (see block 322), working register 952 is initialized (block 328) for counting and is incremented each time an indexing operation is requested by means of the key 26 (blocks 330–334). Such a key depression occurance is indicated by a particular preselected character code at the keyboard buffer 28 and the processor output INDEX is responsively set to the "one" state (block 331). The necessary print cycles are triggered by e.g., pulsing the signal CC to the cycle clutch (element 116, FIG. 4). Such use of the cycle clutch 116 is well known in the typewriter art for power take-off from a drive shaft. If multiple print cycles are required for an indexing operation a flag can be set in a register to account for the second cycle.

Once the print cycles are finished e.g., as indicated by a time interval elapsed or by a feedback signal, the working register 952 is incremented and the signal INDEX is set to the zero state (block 333). If the test (block 330) indicates that no index code has been asserted, a test (block 338) is made for the CODEX code, which also, preferably, serves to signal the end of the input interval. If the CODEX code is asserted, the total in the working register 952 is stored (block 340) in the PIR location 950 of the RAM 44 and a return occurs to the overall input service loop (discussed above). Otherwise, the keyboard buffer 28 is checked for a new code (a second path to block 334).

Referring to FIG. 9, a presently preferred signal processing arrangement for operator input of a first line distance code utilizes the signal PBS of the detector 32 to trigger a conditioning of the processor 36 to receive distance information from the keyboard 20 (FIG. 1). Such distance information, preferably number key codes, is decoded using a stored conversion table or procedure. Corresponding codes representing indexing increments to achieve the desired first line are produced and are stored in the PIR location 950 of RAM 44. Preferably, the transition in the state of signal PBS when the paper bail 14 is transferred from the detection position (see also FIGS. 3 and 10) causes the processor 36 to access the code stored at PIR location 950 and command a corresponding number of indexing operations.

The signal processing sequence that is detected by the structure of the ROS 42, and causes operation according to the invention under control of the processor 36, is now considered with reference to the diagram of FIG. 11. The presently preferred paper insert operational sequence is entered (block 400) from the overall input servicing (or polling) loop implemented by processor 36 (mentioned above) and begins with a test (block 402) to determine the detection state of the detector 32. If the paper hold down device 13 is not in the detection position (see dashed lines FIG. 3), normal processing of the coded signals from keyboard 20 proceeds (block 404), as is well known in the art. By this comparator operation the processor 36 effectively disables or circumvents normal keyboard signal processing if the signal PBS is in the detection state (assumed here to be the logic "one" state). For the detection state of signal PBS, a triple index is triggered (block 406) to nip paper presented at the paper entrance 92 (to free the operator's right hand from holding the paper in place).

A delay is interposed (block 408) until the paper hold-down device 13 is released from the detection position, as indicated by the signal PBS assuming the logic "zero" state, and then the keyboard buffer 28 is accessed (block 410) to determine if the operator has performed any keyboard operations while the paper hold-down device 13 was in the detection position (block 412). If so, the last character code entered is accessed and the buffer 28 is cleared (block 414). The character code is then tested to determine if, in particular, a code corresponding to one of the number keys 22 has been asserted (block 416), this in accordance with the presently preferred implementation for the invention. Such number code is then decoded (block 418) using a table (block 420) stored in the ROS 42 to produce a code representing a preselected number of indexing operations, e.g., the "2" key code preferrably corresponds to two triple indexes. To account for the paper path distance to bring the leading paper edge to the printing line 94 (FIG. 3), a fixed number of indexing operations is added (block 422) to the stored number. At this point or previously if no valid characters were entered (a failure of either the block 412 or block 416 test), the value from the PIR location 950 is duplicated in the working register 952 (block 424).

In a repeated loop (blocks 426, 428, 430, and 432), indexing operations are triggered and the total in the register 952 is decremented with each indexing operation until the register total is reduced to zero (block 432). An emergency stop is provided, for enhancement of operator control and is triggered (block 426) if the paper bail 14 is again moved to the detection position (see dashed line FIG. 3). Once one of the loop tests (block 426 or 432) is satisfied, an emergency stop has occurred or the desired paper insertion has been completed and the output signals INDEX and TRIPL are reset (block 434) to logic "zero" followed by a return to the overall input servicing loop (block 436).

As a further enhancement, an initialization procedure is included in the normal logic operations when the machine is powered on. Such an initialization causes (block 440) a default first line code (e.g. the code representing the number "2") structured into the ROS 42 to be written into the PIR location 950 to provide for the situation where the operator fails to input such a code.

The invention has been described in detail with reference to preferred implementations thereof, however, it will be appreciated that modifications and variations are possible. For example, various detectors may be used to detect the position of the paper bail. Also, rather than use a read only memory structure to coordinate operation of a processor that is capable of using a few basic processing circuits repeatedly the signal processing may be implemented using "unshared" processing circuits, by those having ordinary skill in the art, based on the described methodology of operation for the invention.

We claim:

1. Semi-automatic paper insertion apparatus for use in a typewriter of the kind that establishes a printing line and has keyboard apparatus for producing coded signals and means including a platen for defining a paper feed path, said paper insertion apparatus comprising:

an operator-manipulable paper hold-down device having a first position at the paper feed path and a second position which is away from the paper feed path;

means for detecting the presence of said hold-down device in said second position and for producing a corresponding detection signal;

an indexing device for receiving an indexing control signal and for advancing paper along said paper feed path in accordance with said indexing control signal; and control circuit means for receiving said detection signal, said control circuit means including means for storing a code indicating a paper feed distance along said paper feed path for a first line of printing and means, responsive to said detection signal, for accessing said code and for supplying a corresponding set of indexing control signals to said indexing device whereby paper insertion to a first line for printing is effected.

2. An apparatus according to claim 1 wherein said hold-down device is a paper bail that is resiliantly biased away from said second position whereby a definite manipulation by the operator against an opposing force is necessary to trigger paper insertion.

3. An apparatus according to claim 1 wherein said control circuit means includes means responsive to a predefined keyboard code for establishing a corresponding distance representative code in said storing means whereby operator selection of the paper insertion distance is achieved.

4. A paper insertion apparatus according to claim 2 wherein said detecting means includes a magnet that is coupled to be positioned by said paper bail and a reed switch that is located within actuation proximity of the position assumed by said magnet when said paper bail is in said second position.

5. A semi-automatic paper insertion system for use in a typewriter of the kind that establishes a printing line and has keyboard apparatus for producing coded signals and a platen that cooperates in defining a paper path, said paper insertion system comprising:

a paper hold-down bail having a first position biased against said platen, a second position that is withdrawn from said platen, and a third position that is stable and is intermediate said first and second positions;

a detector that produces a signal to indicate the presence of said bail in the second position;

an indexing device for incrementally rotating said platen in accordance with a control signal;

and controller means including a storage for a coded signal that indicates a number of increments of platen rotation for paper insertion and means, responsive to said detector signal, for accessing said coded signal and for supplying to said indexing device a corresponding set of indexing control signals.

6. A paper insertion system according to claim 5 wherein means is provided for changing said stored coded signal said changing means including means responsive to a preselected keyboard apparatus code to trigger an input interval and means for counting codes produced by an indexing control key to establish at least in part a new code signal for storage.

7. A paper insertion system according to claim 5 wherein resilient means is provided for biasing said paper hold-down bail from said second position toward said third position whereby a definite operator manipulation is required to force said bail into the second position and a transfer from said second position automatically occurs when operator force is released.

8. Semi-automatic paper insertion apparatus for use in a typewriter of the kind that establishes a printing line and has keyboard apparatus for producing coded signals and means including a platen for defining a paper feed path, said paper insertion apparatus comprising:

an operator-manipulable paper hold-down device having a first position at the paper feed path and a second position which is away from the paper feed path;

means for detecting the presence of said hold-down device in said second position and for producing a corresponding detection signal;

an indexing device for receiving an indexing control signal and for advancing paper along said paper feed path in accordance with said indexing control signal;

control circuit means for receiving said detection signal, said control circuit means including means for storing a code indicating a paper feed distance along said paper feed path for a first line of printing and means, responsive to said detection signal, for accessing said code and for supplying a corresponding set of indexing control signals to said indexing device whereby paper insertion to a first line for printing is effected;

and means for changing the stored code indicating a paper feed distance, said changing means including means, responsive to coded index signals produced by operator depression of an indexing key, for counting said coded indexing signals to define a paper feed distance code.

* * * * *